US010189487B2

(12) United States Patent
Warren et al.

(10) Patent No.: US 10,189,487 B2
(45) Date of Patent: Jan. 29, 2019

(54) RAILWAY TRUCK BOLSTER WEAR LINER

(71) Applicant: Amsted Rail Company, Inc., Chicago, IL (US)

(72) Inventors: Richard Warren, Columbia, IL (US); Paul Wike, St. Louis, MO (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 411 days.

(21) Appl. No.: 14/966,032

(22) Filed: Dec. 11, 2015

(65) Prior Publication Data

US 2017/0166223 A1 Jun. 15, 2017

(51) Int. Cl.
*B61F 5/04* (2006.01)
*B61F 5/18* (2006.01)

(52) U.S. Cl.
CPC . *B61F 5/04* (2013.01); *B61F 5/18* (2013.01)

(58) Field of Classification Search
CPC ..... B61F 5/16; B61F 5/18; B61F 5/04
USPC ..... 105/199.4
See application file for complete search history.

(56) References Cited

U.S. PATENT DOCUMENTS 4,224,876 A * 9/1980 Larsen ..... B61F 5/16 105/199.4
4,275,661 A 6/1981 Mowles
4,483,254 A * 11/1984 Meadows ..... B61F 5/18 105/189
5,443,015 A * 8/1995 Rudibaugh ..... B61F 5/16 105/199.4
6,324,995 B1 * 12/2001 Kaufhold ..... B61F 5/16 105/199.4

OTHER PUBLICATIONS

Canadian Patent Office, Office Action dated Oct. 19, 2017, from corresponding Canadian Patent Application No. 2945288, 5 pages.

* cited by examiner

*Primary Examiner* — Robert J McCarry, Jr.
*Assistant Examiner* — Scott A Browne
(74) *Attorney, Agent, or Firm* — Amsted Industries Incorporated

(57) ABSTRACT

A railway truck to railway car body interface is provided. The railway truck is comprised of a bolster supported between two sideframes. The truck bolster includes a center bowl, and the car body includes a body bolster opening. A center plate is placed between the truck bolster center bowl and the car body bolster opening. A wear liner, usually comprised of an elastomeric material, is provided between the sides of the center bowl and the center plate.

12 Claims, 10 Drawing Sheets

RAILWAY TRUCK BOLSTER WEAR LINER

BACKGROUND OF THE INVENTION

A railway freight car is comprised of a car body and two three piece freight trucks. Two center plates are also provided, which are centrally attached and located near the ends of the car body. The center plate is a casting that extends from the car body into a center bowl of the bolster of the three piece freight truck. The three piece freight truck consists of a bolster and two side frames. The vertical weight of the car body is transferred from the bottom of the centerplate to the mating surface of the truck bolster center bowl. Two sidebearings also transfer the loaded weight of the car body to the bolster. The car body weight is then transferred from the bolster through the suspension, into the side frames, and finally through the axles and wheelset, continuing onto the track. The bolster center bowl has a circular vertical wall that captures the center plate lower section circular vertical wall. The circular interface restricts the movement of the center plate to only rotation of the three piece freight truck relative to the car body. The vertical walls between the center bowl and the center plate have a radial space to allow for assembly clearance.

The stability of the railway freight car is a function of track irregularities and mass acceleration, created by the speed of travel. The track irregularities and the speed of travel tend to laterally displace and accelerate the mass of the three piece freight trucks. The laterally displaced and accelerated mass at the bolster center bowl circular vertical wall travels through the radial clearance space impacting the car body center plate lower section vertical circular wall. The impact transfers the lateral displacement and accelerated mass energy into the car body where it is momentarily stored. When the car body restores to equilibrium it returns the displaced mass and energy back through the vertical wall of the center plate, traveling through the radial clearance space and impacting the center bowl of the three piece freight truck. The cycling of displacement of energy causes the railway freight car to become unstable.

The present invention relates to absorbing the displacement energy from the bolster center bowl circular vertical wall to the car body center plate circular vertical wall. Radially preloaded spring elements, placed between the circular walls of the bolster center bowl and car body center plate lower section circular vertical wall, eliminate the impact and absorb the displacement energy being transferred between the three piece truck and car body. Absorbing the displacement energy between the car body and three piece truck, allows increased speed of travel while maintaining the stability of the railway freight car.

SUMMARY OF THE INVENTION

Track irregularities coupled with the speed of travel of the freight car laterally displace and accelerate the mass of three piece freight trucks. The laterally displaced and accelerated mass at the bolster center bowl circular vertical wall travels through the radial clearance space impacting the car body center plate lower section vertical circular wall. This impact transfers the displaced and accelerated mass energy into the car body where it is momentarily stored. When the car body restores to equilibrium, the displaced mass and energy return and the impact between the center plate and center bowl walls is reversed. The returned displacement of energy causes the railway freight car to become unstable.

The present invention relates to absorbing the displacement energy between the bolster center bowl circular vertical wall to the car body center plate lower section circular vertical wall. Radially preloaded spring elements, placed between the circular walls of the bolster center bowl and car body center plate lower section vertical wall, eliminate the impact and absorb the displacement energy being transferred between the three piece truck and car body. Absorbing the displacement energy between the car body and three piece truck, allows increased speed of travel while maintaining the stability of the railway freight car.

DETAILED DESCRIPTION OF THE INVENTION

Figure 1:
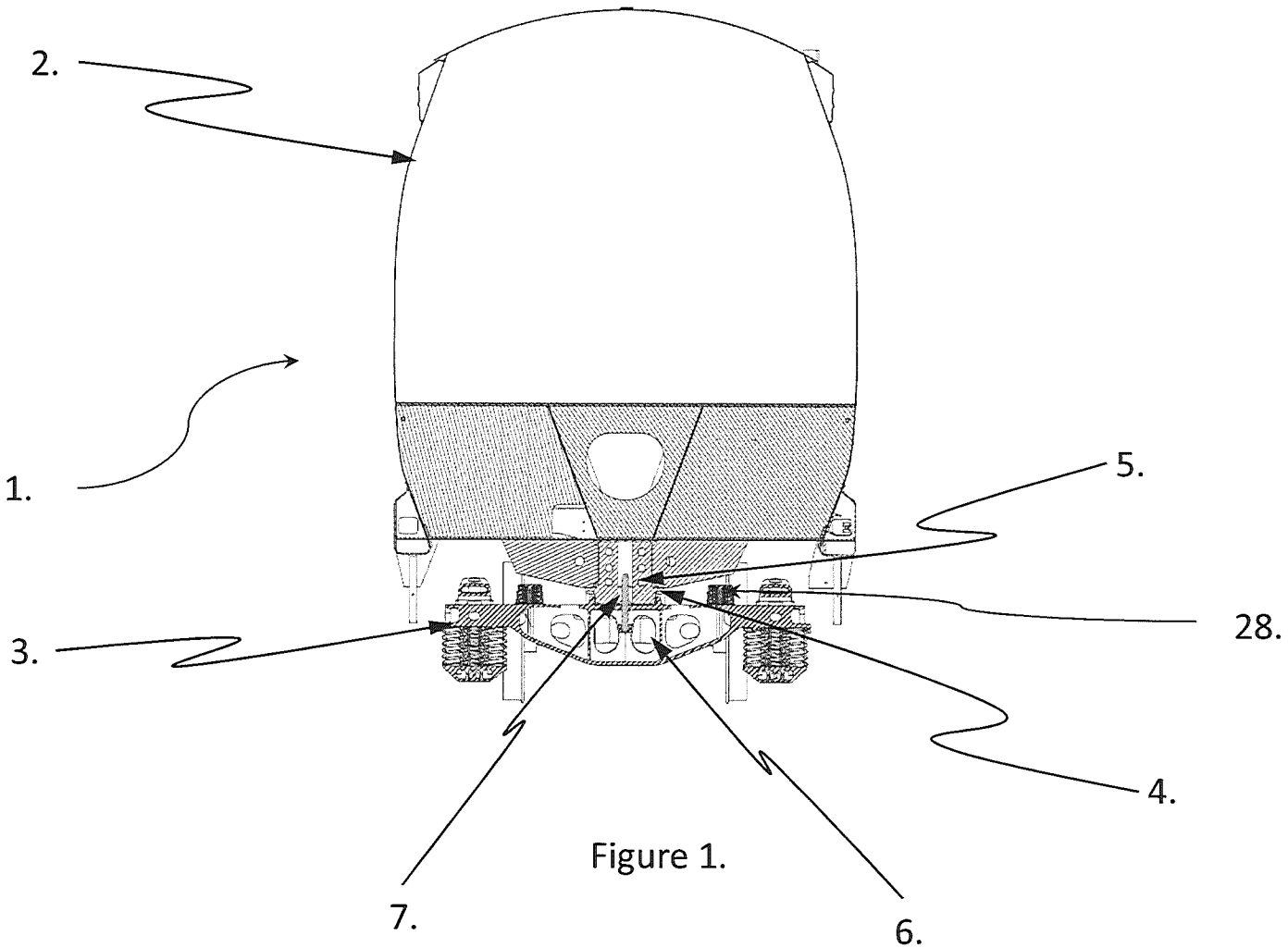
FIG. 1 is a sectional view of a railway freight car of a railway truck to car body interface assembly in accordance with a first embodiment of the present invention.

Referring now to FIG. 1, a railway freight car 1 is seen to be comprised of a car body 2, and a three piece freight car truck 3. The car body 2 includes center plate 5, centrally attached near the end of car body 2. Center plate 5 extends down from car body 2, into the center bowl 4 of bolster 6 of the three piece freight car truck 3. There is also a king pin 7, centered between the center bowl 4 and center plate 5 and extending into central openings in each. King pin 7 is used to locate the car body 2 above three piece truck 3 during assembly, as well as a guide to keep the three piece truck 3 under the car body 2, if they were to become vertically disengaged in service. Side bearings 28 are present between bolster 6 and car body 2 to assist in supporting the loaded weight of car body 2.

Figure 2:
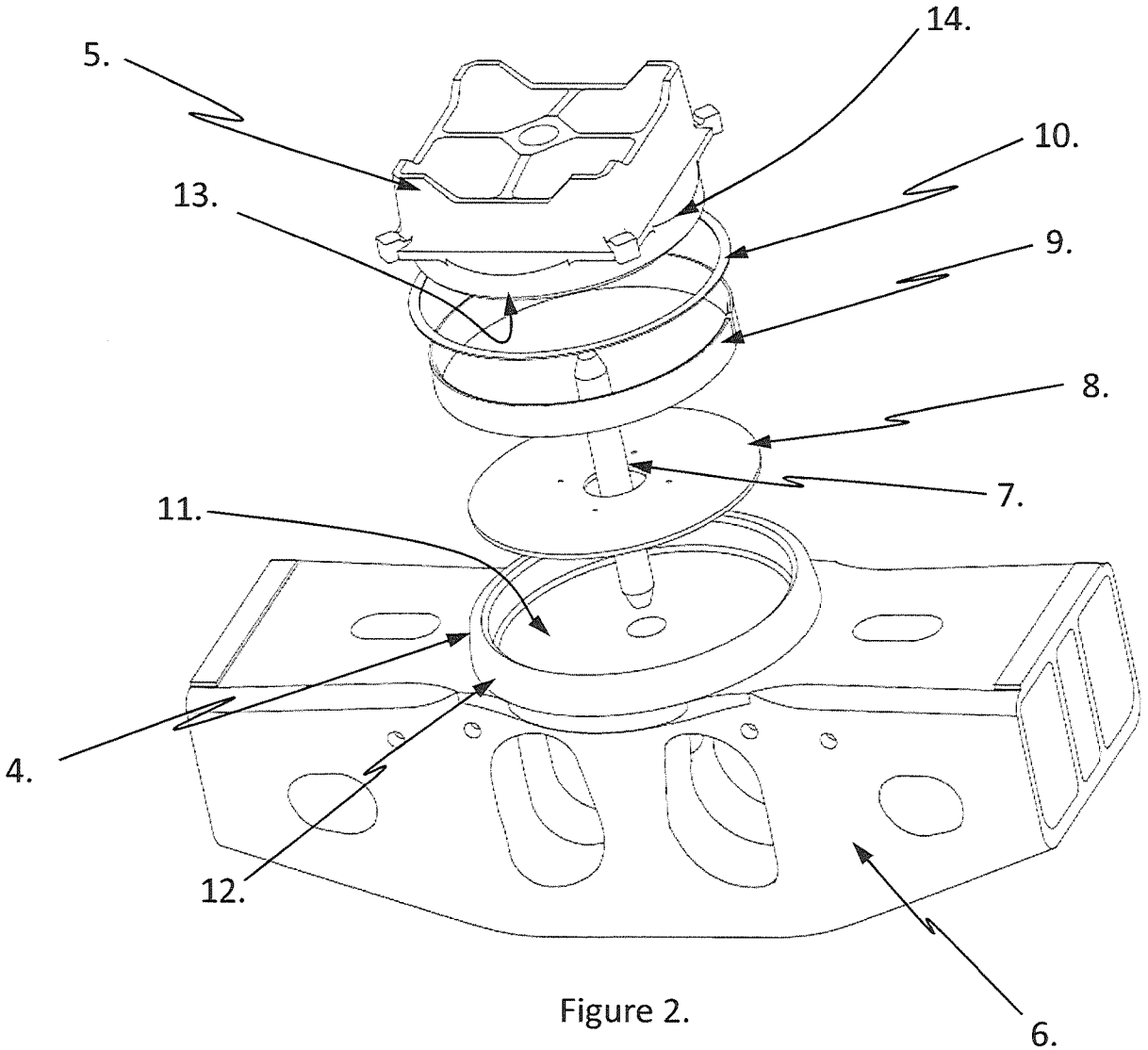
FIG. 2 is a partial exploded view of the center bowl relationship to the center plate with an elastomeric vertical wear liner of a railway truck to car body interface assembly in accordance with a first embodiment of the present invention.

Referring now to FIG. 2, a partial exploded view is provided of bolster 6, with center bowl 4, center bowl surface 11, and circular vertical wall 12. Center plate 5 has a generally square, four sided upper section and a lower section circular vertical wall 14, with a bottom 13. The car body weight is transferred through center plate bottom 13 to a horizontal wear liner 8. Horizontal wear liner 8, usually comprised of steel, further transfers the car body weight to surface 11 of center bowl 4. The three piece truck pivots about the center bowl 4 and center plate 5. The center bowl 4 circular vertical wall 12 restricts the movement of center plate 5 lower section circular vertical wall 14, to rotation. There is an elastomeric vertical liner 9 between the center plate 5 lower section circular vertical wall 14 and the center bowl 4 circular vertical wall 12. Elastomeric vertical liner 9 has an interference fit between the center plate 5 lower section circular vertical wall 14, and the center bowl 4 circular vertical wall 12. There is compression at the interference fit between center plate 5 lower section circular vertical wall 14, to the center bowl 4 circular vertical wall 12. Center plate 5 is usually a unitary cast steel structure. Elastomeric vertical wear liner 9 is usually comprised of an elastic material with stiffness sufficient to create a preload between the center plate 5 lower section circular vertical wall 14, and the center bowl 4 circular vertical wall 12, when compressed. Circular shaped retainer 10 protects the elastomeric vertical wear liner 9 from being displaced or crushed during assembly of the car body 2 to the three piece truck 3. Retainer 10 also keeps the elastomeric vertical wear liner 9 in place during travel of truck 3.

Figure 3:
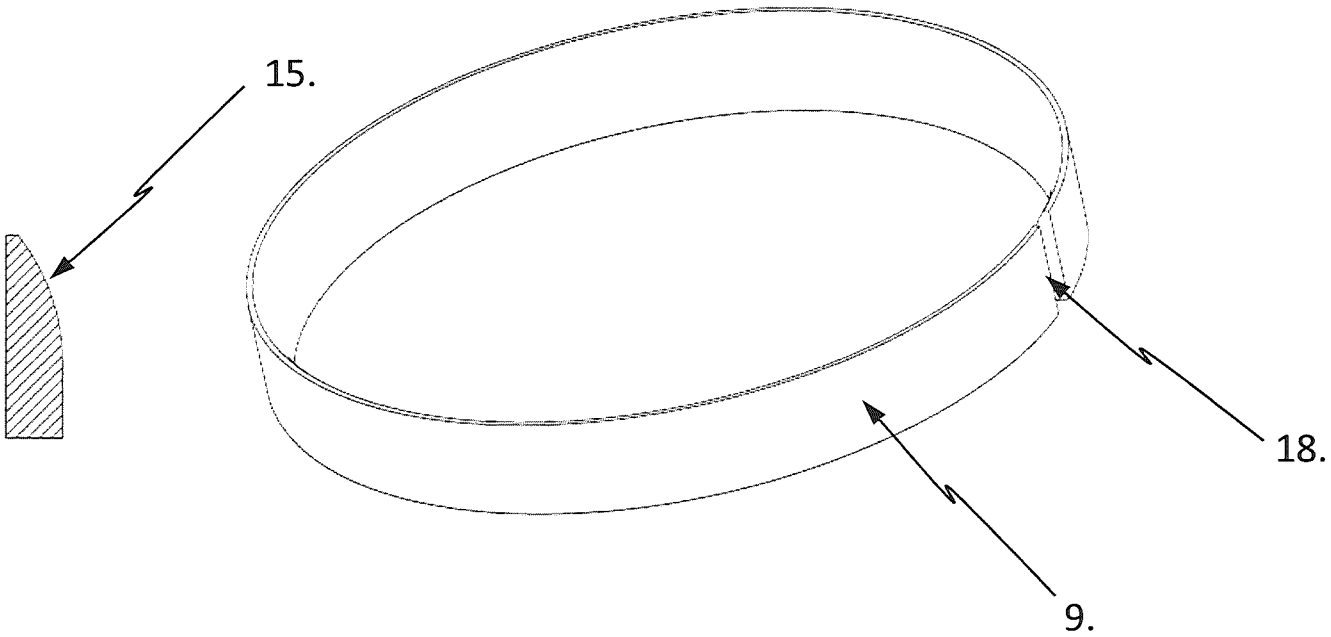
FIG. 3 is an isometric view of the elastomeric vertical wear liner of a railway truck to car body interface assembly in accordance with a first embodiment of the present invention.

Referring now to FIG. 3, an isometric view of the elastomeric vertical wear liner 9 is provided. The elastomeric vertical wear liner 9 has a gap 18, to compensate for the tolerance in manufacture of center bowl 4. The vertical wear liner has a curved surface 15, on the inner diameter to aid in the assembly insertion of center plate 5 lower section circular vertical wall 14 into center bowl 4.

Figure 4:
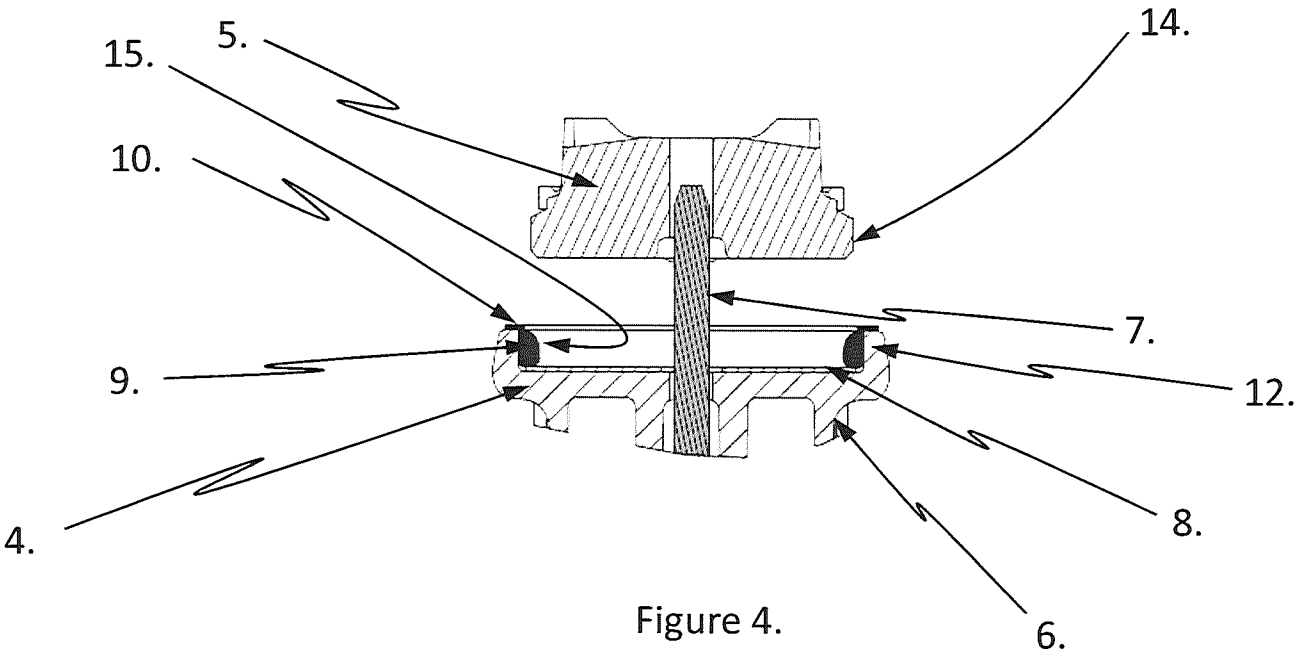
FIG. 4 is a detailed partial exploded section view of the center bowl relationship to the center plate of a railway truck to car body interface assembly in accordance with a first embodiment of the present invention.

Referring now to FIG. 4, a detailed partial exploded view of the bolster 6, with center bowl 4 and center plate 5, is provided. The elastomeric vertical wear liner 9, is an elastic material, and is shown non-compressed. The elastomeric vertical wear liner 9 outer diameter bears against the center bowl 4 circular vertical wall 12. The elastomeric vertical wear liner 9, has a curved surface 15, on the inside diameter which will allows center plate 5 lower section circular vertical wall 14 entry into center bowl 4. As the center plate 5 lower section circular vertical wall 14 engages the elastomeric vertical wear liner 9 curved surface 15, wear liner 9 will become compressed, preloading the elastomeric vertical wear liner 9. The elastomeric vertical wear liner 9 is protected from being crushed by circular retainer 10 which is positioned on top of wear liner 9 and between its interface with center plate 5.

Figure 5:
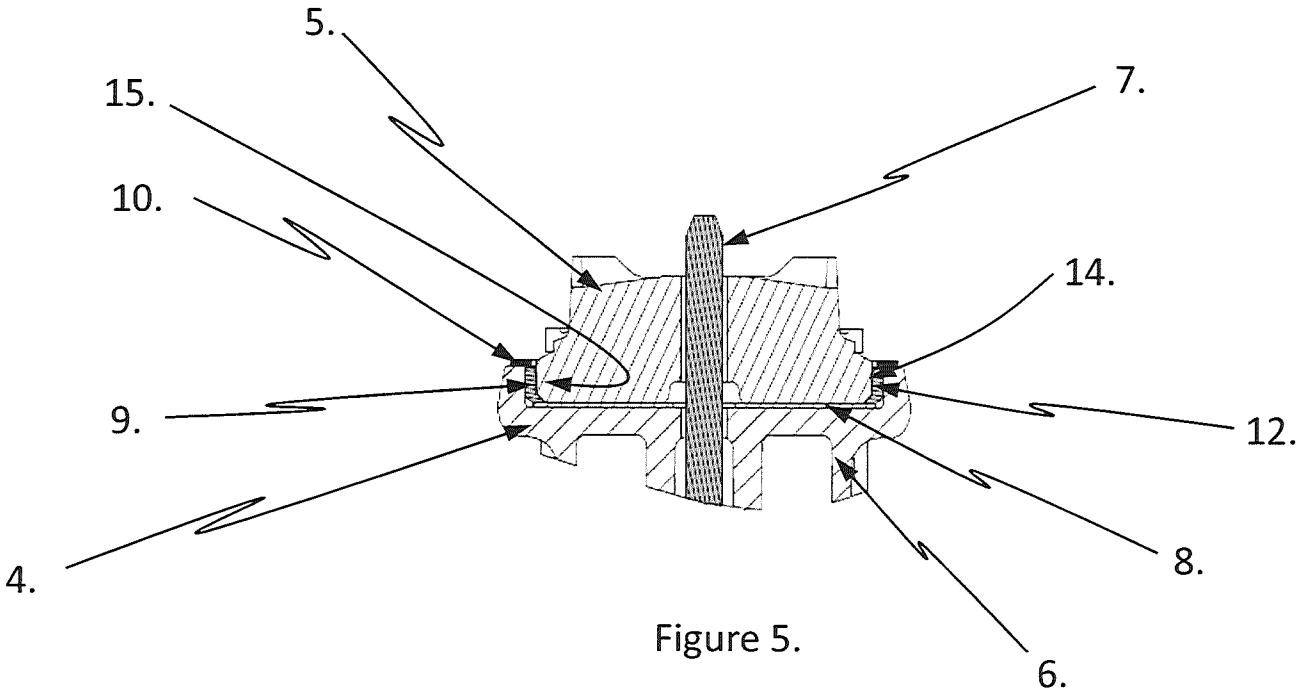
FIG. 5 is a detailed partial section view of the center bowl engaged in the center plate of a railway truck to car body interface assembly in accordance with a first embodiment of the present invention.

Referring now to FIG. 5, a detailed partial section view of the center plate 5 lower section circular vertical wall 14 inserted into center bowl 4 is provided. The elastomeric vertical wear liner 9 is compressed between center bowl 4 circular vertical wall 12 and center plate 5 lower section circular vertical wall 14. The elastomeric vertical wear liner 9, curved surface 15, is compressed preloading elastomeric vertical wear liner 9.

Figure 6:
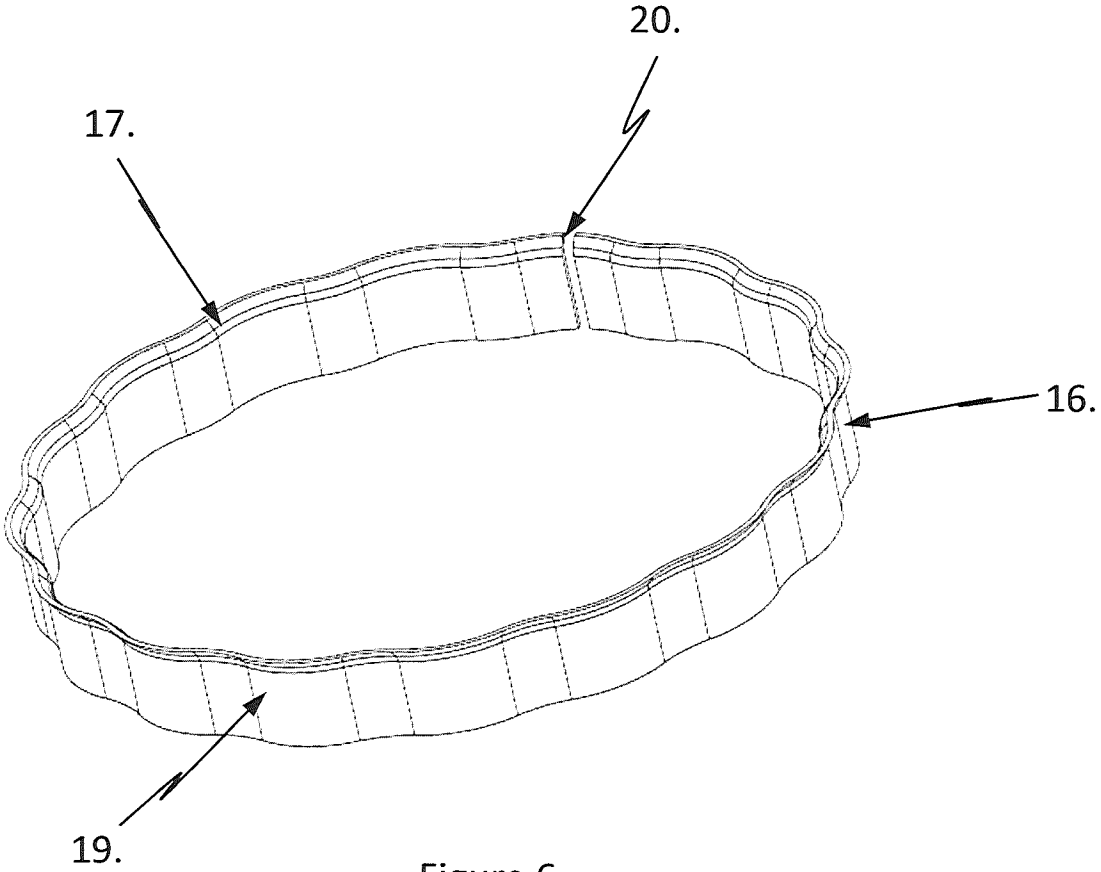
FIG. 6 is an isometric view of the linear spring vertical wear liner of a railway truck to car body interface assembly in accordance with a second embodiment of the present invention.

Referring now to FIG. 6, an isometric view of a linear spring vertical wear liner 16 is provided. The linear spring vertical wear liner 16 is a metallic spring which develops it stiffness by deflecting the curved surfaces 19, which make up the walls of the linear spring vertical wear liner 16. The top of the linear spring vertical wear liner 16 has a tapered surface 17, to aid in the assembly. The liner spring vertical wear liner 16 has a gap 20, to compensate for the tolerance in manufacture of center bowl 4.

Figure 7:
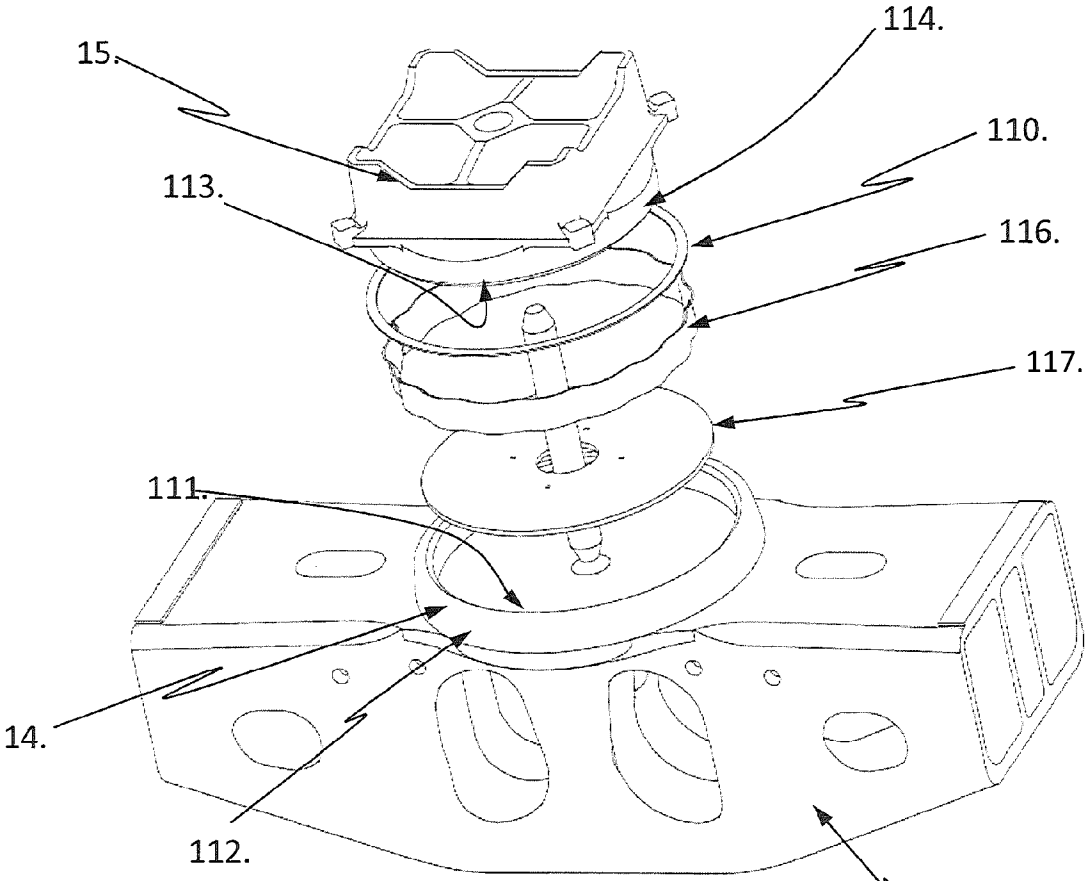
FIG. 7 is a partial exploded view of the center bowl relationship to the center plate with a linear spring vertical wear liner of a railway truck to car body interface assembly in accordance with a second embodiment of the present invention.

Referring now to FIG. 7, a partial exploded view of the bolster 16, with center bowl 14, consisting of a center bowl bottom surface 111 and circular vertical wall 112. Center plate 15 has a generally square, four sided upper section and a lower section circular vertical wall 114, with a bottom 113. The car body weight is transferred through center plate 15 bottom 113, to the horizontal wear liner 117. Horizontal wear liner 117, usually comprised of steel, further transfers the car body weight to surface 111 of center bowl 14. The three piece truck pivots about the center bowl 14, and center plate 15. Center bowl 14 circular vertical wall 112 restricts the relative movement of center plate 15 and center bowl circular vertical wall 114, to rotation. There is a linear spring vertical wear liner 116 between the center plate 15 lower section circular vertical wall 114, and center bowl 14 circular vertical wall 112. The linear spring vertical wear liner 116, has an interference fit between the center plate 15 lower section circular vertical wall 114, and center bowl 14 circular vertical wall 112. Linear spring vertical wear liner 116 is comprised of a metallic spring material with a stiffness to create a preload between the center plate 15 lower section circular vertical wall 114, and center bowl 14 circular vertical wall 112, when compressed. Circular retainer 110 protects the linear spring vertical wear liner 116 from being displaced or crushed during assembly of the car body to the three piece truck. Retainer 110 also keeps the linear spring vertical wear liner 116 in place during travel of the three piece truck.

Figure 8:
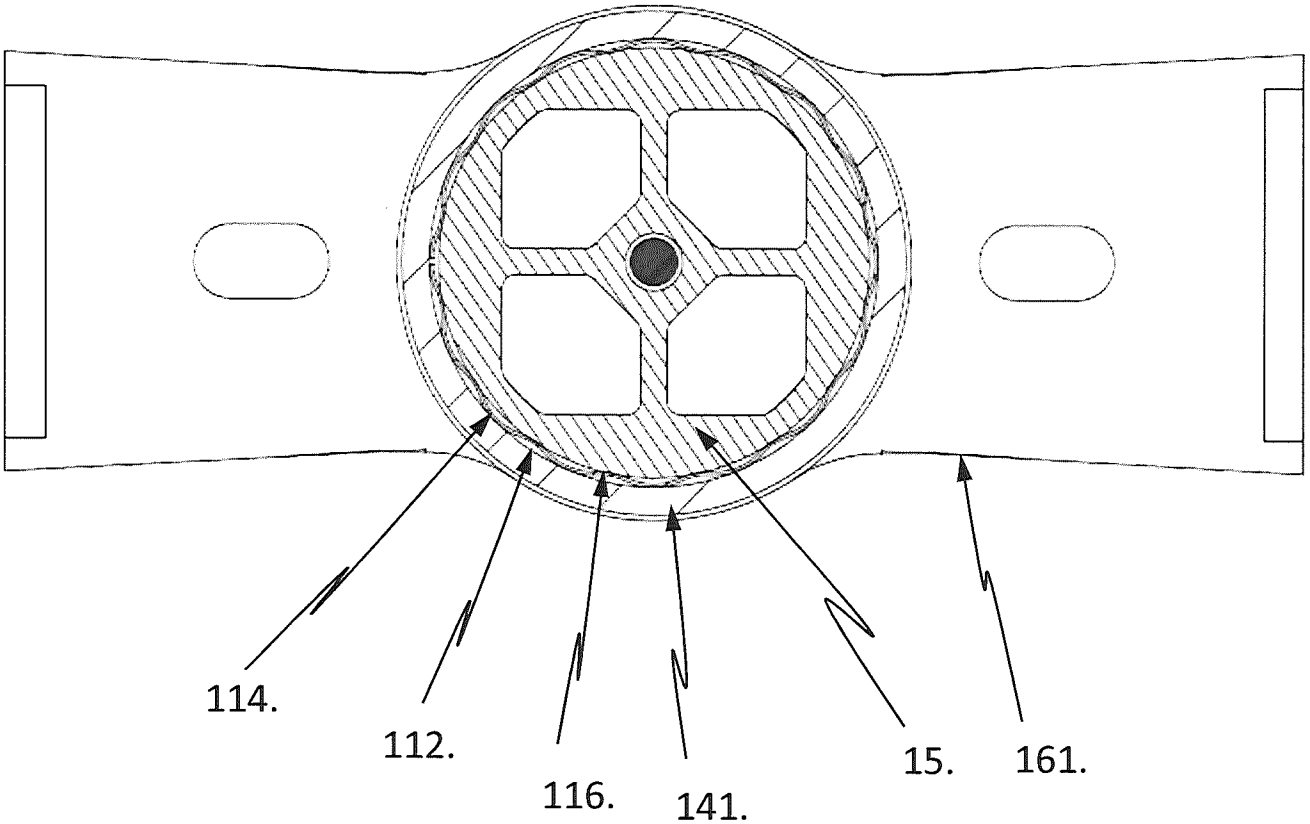
FIG. 8 is a partial top view of the bolster and the relationship of the center bowl and sectioned center plate with the linear spring vertical liner of a railway truck to car body interface assembly in accordance with a second embodiment of the present invention.

Referring now to FIG. 8, a partial top view of the bolster 161, and the relationship of the center bowl 141, sectioned center plate 15, with the linear spring vertical liner 116. The linear spring vertical liner 116 with a spring curved surface, is alternately pressing against the circular vertical wall 112, of the center bowl 141, and the lower section circular vertical wall 114, of center plate 15. The curved surface is a compressed spring with a stiffness that preloaded the center bowl 141 to centerplate 15.

Figure 9:
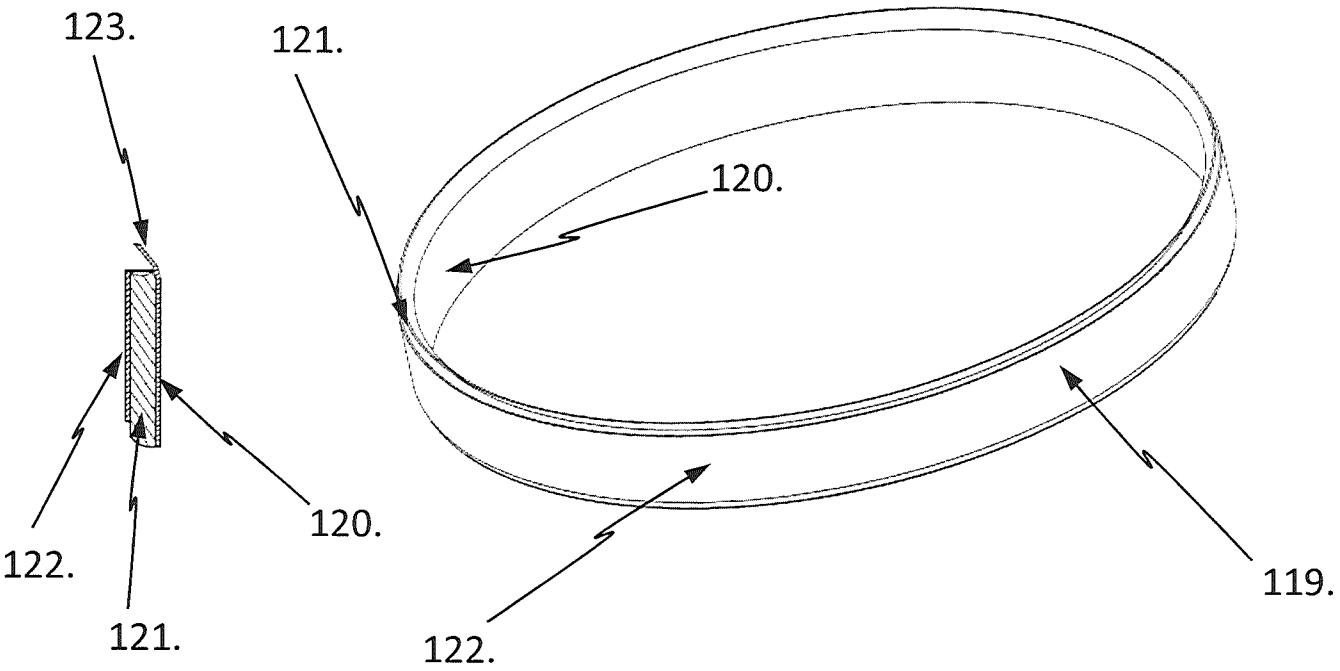
FIG. 9 is an isometric view of the bonded vertical wear liner of a railway truck to car body interface assembly in accordance with a third embodiment of the present invention.

Referring now to FIG. 9, an isometric view of the bonded vertical wear liner 119. The bonded vertical wear liner 119, consists of a thin layer of low friction material 120, on the inside diameter, bonded to an elastomeric center layer 121. The bonded wear liner 119, also has an outer diameter metal layer that is bonded to the elastomeric center layer 121. The bonded wear ring 119 has a sloped surface 123, on the top of the inside diameter low friction surface 120. The slope surface 123, guides the center plate circular vertical wall into the low friction surface 120. Outside diameter low friction surface 122 is also present.

Figure 10:
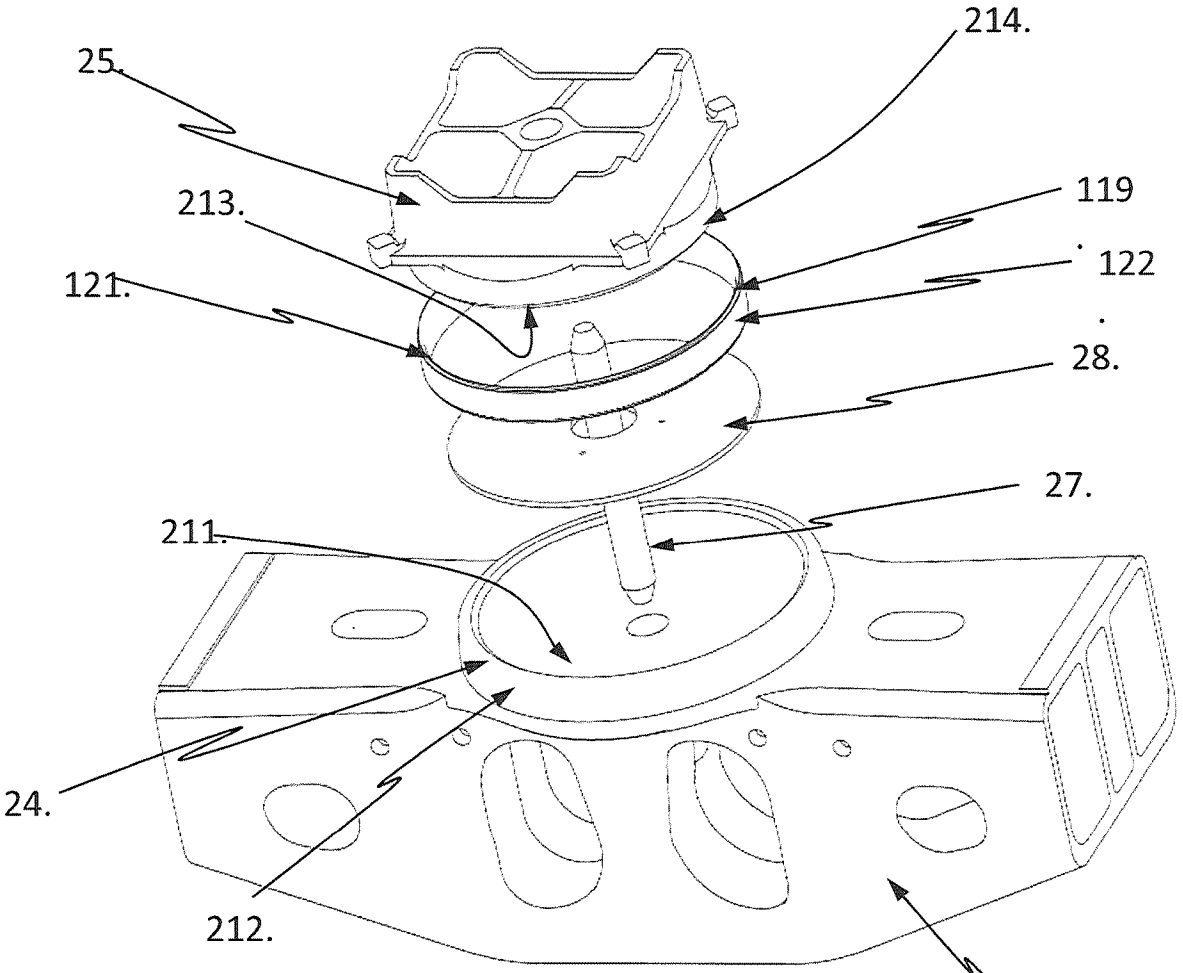
FIG. 10 is a partial exploded view of the center bowl relationship to the center plate with a bonded vertical wear liner of a railway truck to car body interface assembly in accordance with a third embodiment of the present invention.

Referring now to FIG. 10, a partial exploded view of the bolster 26, with center bowl 24, consisting of a center bowl bottom surface 211, and circular vertical wall 212. The center plate 25 has a generally square, four sided upper section and a lower section circular vertical wall 214, with a bottom 213. The car body weight is transferred through center plate 25 bottom 213, to the horizontal wear liner 28.

The horizontal wear liner 28, usually comprised of steel, further transfers the car body weight to the surface 211 of center bowl 24. The three piece truck pivots about the center bowl 24, and center plate 25. The center bowl 24, circular vertical wall 212, restricts the movement of center plate 25, lower section circular vertical wall 214, to rotation. There is a bonded vertical wear liner 119, between the center plate 25, lower section circular vertical wall 214, and the center bowl 24, circular vertical wall 212. The bonded vertical wear liner 119, has an interference fit between the center plate 25, lower section circular vertical wall 214, and the center bowl 24, circular vertical wall 212. The bonded vertical wear liner 119, has an elastic center material 121, with a stiffness sufficient to create a preload between the center plate 25, lower section circular vertical wall 214, and the center bowl 24, circular vertical wall 212, when compressed. The bonded vertical wear liner 119, outer ring 122, is press fit against the center bowl 24, circular vertical wall 212 inside. The press fit is the means to retain the bonded vertical wear liner 119 to center plate 24.

What is claimed is:

1. A railway car truck interface assembly comprising:

a railway car truck bolster, the bolster including a center bowl of circular shape with a raised wall and a centrally located opening, a horizontal wear liner received in the bolster center bowl, a center plate having an upper section comprised of four sides and a lower section, the lower section having an outer circular edge extending downwardly from the upper section, the center plate including a centrally located opening, the lower section of the center plate received in the bolster center bowl, with a pin extending into the centrally located opening in the bolster center bowl and into the centrally located opening in the center plate, an annular edge wear liner between the center bowl raised wall and the outer circular edge of the lower section of the center plate, the edge wear liner including a metallic spring material; and an undulating wall of the edge wear liner intermediate the center bowl raised wall and the outer circular edge of the lower section of the center plate;

wherein the edge wear liner has a split-ring configuration that allows the edge wear liner to be elastically compressed when the center plate is placed in the bolster center bowl.

2. The railway car truck interface assembly of claim 1 further comprising a retainer of a circular shape between a top surface of the edge wear liner and the center plate.

3. The railway car truck interface assembly of claim 1 wherein the edge wear liner includes an elastomeric material.

4. The railway car truck interface assembly of claim 1 wherein the edge wear liner is compressed when the center plate is placed in the bolster center bowl.

5. A railway car truck interface assembly comprising:

a railway car truck bolster, the bolster including a circular center bowl formed by a raised sidewall and having a centrally located opening, a horizontal wear liner received in the bolster center bowl, a center plate comprising a square upper section having four sides and a circular lower section, the center plate lower section having an outer circular edge extending downwardly from the upper section, the center plate including a centrally located opening, the circular lower section of the center plate extending into the bolster center bowl, with a pin extending into the centrally located opening in the bolster center bowl and into the centrally located opening in the center plate, and an annular edge wear liner between the center bowl raised sidewall and the outer circular edge of the lower section of the center plate, the edge wear liner including:

an elastomeric center layer;

a radially inner layer bonded to the elastomeric center layer; and a radially outer metal layer bonded to the elastomeric center layer so that the elastomeric center layer is sandwiched between the radially inner layer and the radially outer metal layer.

6. The railway car truck interface assembly of claim 5 further comprising a retainer of a circular shape between a top surface of the edge wear liner and the center plate.

7. The railway car truck interface assembly of claim 5 wherein the edge wear liner is compressed when the center plate is placed in the bolster center bowl.

8. The railway car truck interface assembly of claim 5 wherein the edge wear liner extends without interruption around the outer circular edge of the center plate lower section.

9. The railway car truck interface assembly of claim 5 wherein the radially inner layer of the edge wear liner has a surface of a low friction material facing the outer circular edge of the lower section of the center plate.

10. A railway car truck interface assembly comprising:

a railway car truck bolster, the bolster including a center bowl of circular shape with a raised wall and a centrally located opening, a horizontal wear liner received in the bolster center bowl, a center plate having an upper section comprised of four sides and a lower section, the lower section having an outer circular edge extending downwardly from the upper section, the center plate including a centrally located opening, the lower section of the center plate received in the bolster center bowl, with a pin extending into the centrally located opening in the bolster center bowl and into the centrally located opening in the center plate, an annular edge wear liner between the center bowl raised wall and the outer circular edge of the lower section of the center plate, the edge wear liner including a metallic spring material; and an undulating wall of the edge wear liner intermediate the center bowl raised wall and the outer circular edge of the lower section of the center plate;

wherein the edge wear liner includes an undulating tapered surface configured to direct the outer circular edge of the center plate lower section into the center bowl.

11. The railway truck interface assembly of claim 5 wherein the radially inner layer of the edge wear liner includes a sloped surface.

12. The railway truck interface assembly of claim 5 wherein the elastomeric center layer includes a curved lower surface extending between the radially inner layer and the radially outer metal layer.

* * * * *